United States Patent [19]

Pollard

[11] Patent Number: 4,979,346

[45] Date of Patent: Dec. 25, 1990

[54] WINDOW AND DOOR FRAME

[76] Inventor: Wilfred C. Pollard, 70 Cornwall Street, Plymouth, Devon, United Kingdom

[21] Appl. No.: 384,091

[22] Filed: Jul. 24, 1989

Related U.S. Application Data

[63] Continuation of Ser. No. 120,833, Oct. 29, 1987, abandoned.

[51] Int. Cl.[5] ..... E06B 3/22

[52] U.S. Cl. ..... 52/656; 52/397; 52/775; 49/DIG. 1; 49/DIG. 2

[58] Field of Search ..... 52/397, 398, 475, 476, 52/656, 775, 776, 731; 49/DIG. 1, DIG. 2

[56] References Cited

U.S. PATENT DOCUMENTS

| | | | |
|---|---|---|---|
| 3,016,993 | 1/1962 | Owen | 52/397 |
| 3,205,630 | 9/1965 | Felix et al. | 52/775 X |
| 3,436,885 | 4/1969 | Rothermel | 52/775 X |
| 4,074,490 | 2/1978 | Nagase . | |
| 4,207,707 | 6/1980 | Holdiman et al. . | |
| 4,640,078 | 2/1987 | Haffer | 52/656 X |

FOREIGN PATENT DOCUMENTS

| | | | |
|---|---|---|---|
| 0202510 | 4/1986 | European Pat. Off. . | |
| 1509557 | 5/1969 | Fed. Rep. of Germany | 52/775 |
| 2324660 | 1/1974 | Fed. Rep. of Germany | 52/775 |
| 2833738 | 2/1980 | Fed. Rep. of Germany | 52/397 |
| 660242 | 10/1951 | United Kingdom . | |
| 949997 | 2/1964 | United Kingdom . | |
| 993511 | 5/1965 | United Kingdom | 52/775 |
| 1546341 | 5/1979 | United Kingdom . | |

*Primary Examiner*—Richard E. Chilcot, Jr.
*Attorney, Agent, or Firm*—Thomas J. Greer, Jr.

[57] ABSTRACT

A molding for a UPVC sealed unit double glazed window or door comprises core and adaptor sections which may be assembled together to provide L, T or Z cross sections, in which the adaptor sections are provided with tongues which are longitudinally slidably insertable in grooves formed in the core section and are laterally retained therein. Profiled glazing strips have an angled tongue for insertion and retention within a groove of a core section by the presence of the glazing and sealing gaskets.

6 Claims, 5 Drawing Sheets

WINDOW AND DOOR FRAME

This application is a continuation of Ser. No. 07/120,833, filed Oct. 29, 1987, now abandoned.

This invention relates to window and door frames, in particular to moldings used in the manufacture of plastic and other window and door frames, especially for the provision of sealed-unit double glazed windows and doors.

Plastic window and door frames are increasingly popular, being frequently specified both for new buildings and for the replacement market, especially where it is desired to fit a sealed-unit double glazings, and are referred to in the, trade as "UPVC" windows, doors or frames. Moldings needed to provide the various different types of window (such as, for example, sliding patio doors, standard vertically-hinged opening casements, tilt-and-turn casements which tilt about a horizontal axis for ventilation and which open inwardly about a vertical side axis for cleaning, horizontally-hinged outward-opening ventilators and the like, as well as for various styles, such as multi-paned windows which require transom and mullions) are required to be produced in various cross-sectional shapes. For example, a standard side frame molding will have a main box section and a subsidiary box section integrally formed at one side only to define an L in cross-section; a mullion for fixed lights either side will have a subsidiary box section crossing the end of the main box section to define a T; and a mullion with a fixed light to one side and an opening casement to the other may require oppositely and alternately disposed subsidiary box sections, to define a Z in cross-section. The moldings should also be formed, or be capable of being formed, with channels to accommodate operating mechanisms such as friction stays, tilt-and-turn mechanisms, sliding latches and the like. Generally these channels have standard dimensions irrespective of the manufacturer, at least for use in Europe, and are referred to in the trade as "Eurochannels".

Depending on the intended use, window and door frames are in general either heavy-duty (so-called "architectural" specification) size or light-duty ("slim-line" specification) size. For some particular applications, an intermediate-duty size is also used. Thus, for L, T and Z sections, nine (or, more commonly, six) basic moldings are required and, including the provision of mechanism channels, eighteen (or, more commonly, twelve) mouldings are required, and this creates exceptionally high costs, not only in terms of manufacturing machinery and dies but also in terms of storage, distribution and inventory level.

Having formed the required types of molding into a frame, glazing is then inserted into the rebate formed between the main and subsidiary sections and secured in place by glazing beads, generally held in place in grooves formed in the moldings. Desirably, glazing is carried out from the interior of the building. Thus, in the case for example of an "L" section side molding for a window having a non-opening main light and an outwardly-opening top ventilator, the subsidiary side box section should face to the outside over the extent of the main light, to allow interior glazing, and to the inside for the ventilator, to allow the ventilator to open outwardly. For this purpose, an assembly process known as reverse butt welding is followed, in which the side molding is cut through at a point between the main light and the ventilator and the two portions are welded together at their ends in the opposite fashion, to provide the subsidiary box section to the front (or outside) over some of its length and to the back (or inside) over the remainder. However, reverse butt welding is labor- and time-intensive and furthermore is difficult to achieve with precision, since the welding process consumes an unspecified length of molding.

Overall, the manufacture of moldings in integral lengths and their assembly into complete door or window frames is highly expensive, particularly in view of the large number of different types of molding required.

One proposal for reducing the number of required manufactured moldings, to enable the various sections to be built up from a smaller number of members which fit together in different ways to provide the "L", "T" and "Z" sections, is described in GB No. 2166792A, according to which a profiled strip having an angled portion to define the glazing rebate is positively snap locked into a box-shaped basic section between latching zones provided on opposed sides of the section. The strip is itself provided with a latching projection for snap-engagement of a glazing bead. However, although the profiled strips can be inserted either way round on both sides, or on one side only, of the basic section, thus enabling all three of the required cross-sectional shapes to be provided from two moldings, it is not possible to provide such sections with mechanism channels due to the fact that the strips extend across the entire width of the basic section. Furthermore, in practice it is found that the profiled strips are not sufficiently securely held in the basic section to provide adequate security without substantial additional reinforcement, for example by way of screws.

It is an object of the present invention to provide window and door frame moldings which can be built up from a minimum number of parts, thereby effecting substantial savings in manufacture, distribution storage and inventory costs irrespective of the particularly shape of molding required. Further objects include the provision of such moldings which in addition can be formed with channels for receipt of operating mechanisms, and which avoid the need for reverse butt welding during the assembly of frames from the mouldings.

According to the present invention, a composite window or door frame molding comprises a core section and an adaptor section interlockable in the core section, wherein the interlocking means comprise a tongue and groove arrangement, in which the tongue is insertable in the groove by longitudinally sliding therein and once inserted is laterally retained therein.

Preferably the core section is generally of regular quadrilateral form, for example rectangular, provided with grooves such that one or more adaptor sections each provided with a tongue are attachable to the core section at corner regions therefore. In particular, either a single adaptor section may be attached to form an L section molding or two adaptor sections may be attached to form T or Z section mouldings. The tongues are shaped for sliding engagement within the grooves, lateral retention being achieved preferably by interlocking tongue/groove profiles. For example, the extremity of the tongue may be formed with laterally extending portions which are slidingly receivable within opposed corresponding channels formed in the walls of the grooves, but which prevent lateral withdrawal of the tongue from the groove. Facing surfaces of the adaptor and/or core sections may be profiled to reduce the mating surface area in order to reduce friction on sliding the tongue in the groove.

According to a preferred aspect of the invention, the core section is provided with a longitudinal channel formed in one or more of the faces thereof to accommodate window or door operating mechanisms. This feature is rendered possible according to the invention because the adaptor sections are confined to respective corner regions of the core section and do not extend across the width of any face thereof.

Profiled strips for glazing may be inserted in the grooves in the core sections opposite those holding adaptor sections and are retainable therein by the presence of the glazing. Preferably, such strips are provided with an inwardly-angled longitudinal tongue for retention within the groove, such that the tongue can be inserted into the groove by holding the strip at an angle facing towards the glazing or the space to be occupied by the glazing, whereby the tongue is insertable within the groove, and then tilting the strip to an upright position. The tongue, which is preferably provided at its extremity with a laterally extending portion to cooperate when the strip is in the upright position with a corresponding channel formed in the inner wall of the groove, is in this position laterally retained in the groove and, once the glazing and resilient sealing gaskets are inserted between the adaptor section and the profiled strip, is prevented from tilting back to the angled position and is thus held by the glazing in the retained position.

With suitable choice of size for the tongues on the adaptor sections and profiled glazing strips respectively and for the preferred laterally-extending portions thereof, the inner of the opposed channels formed in the walls of the groove for receipt of the laterally-extending portions of the tongue of the adaptor section also is capable of receiving the laterally-extending portion of the tongue of the profiled glazing strip.

Adaptor sections and profiled glazing strips are formed with longitudinal grooves into which resilient weather-sealing elements or gaskets may be inserted. Adaptor sections and glazing strips may have any desired cross-sectional shape, disregarding tongues, noses for retaining sealing elements, and the like, for example triangular or rectangular, according to aesthetic considerations.

In use, moldings according to the invention are built up by sliding one or more adaptor sections into a core section to provide an L, T or Z cross-sectional shape and welding in place. Composite mouldings may then be cut to the desired length for the manufacture of frames. Alternatively, frames may be built up from pre-cut lengths of core section and adaptor section, for example to provide a side frame with an adaptor section at the front (or outside) over some of its length and to the rear (or inside) over the remainder, without the need for reverse butt welding.

Having prepared a frame from composite moldings according to the invention, the glazing is inserted by insertion of a resilient gasket strip in the adaptor section, placing the glazing in position against the gasket, clipping in position in the groove in the core section a profiled glazing strip and finally securing the same by insertion of a second resilient gasket between the glazing and the glazing strip. The second gasket prevents the glazing strip from being tilted to its position of removal from the groove in the core section. To remove the glazing, the second gasket is prized out of position and removed, whereupon the glazing strip is removed and thus the glazing. However, since the invention allows glazing to be inserted from the interior, no security hazard is thereby presented.

The use of the invention allows composite frame moldings of any cross sectional shape to be assembled from one core section for each size of molding, together with adaptor sections and profiled glazing strips which are of universal size for any size of core section. Furthermore, a channel for accommodation of operating mechanisms may be provided in one face of the core section which may be used either way round according to where, and in relation to which adaptor sections, the channel is required.

Embodiments of the invention will now be described by way of example with reference to the accompanying drawings, of which:

Figure 5A:
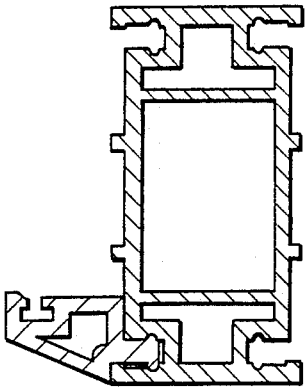
Figure 5B:
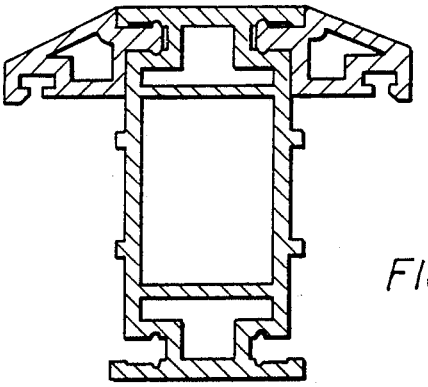
Figure 5C:
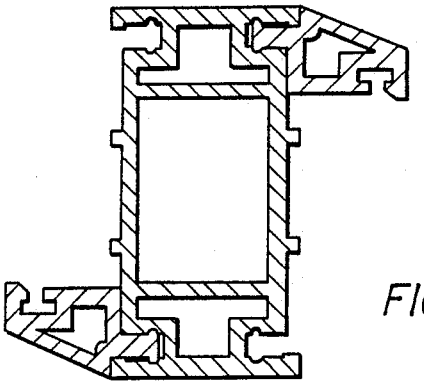
Figure 6:
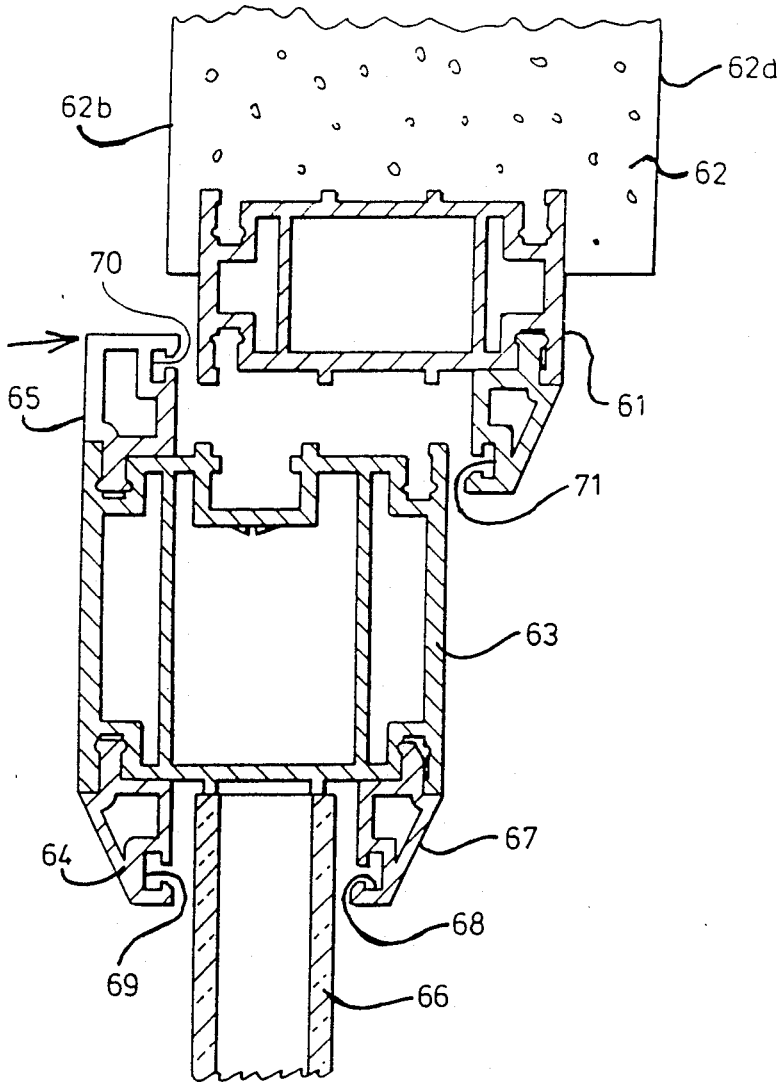
Figure 7:
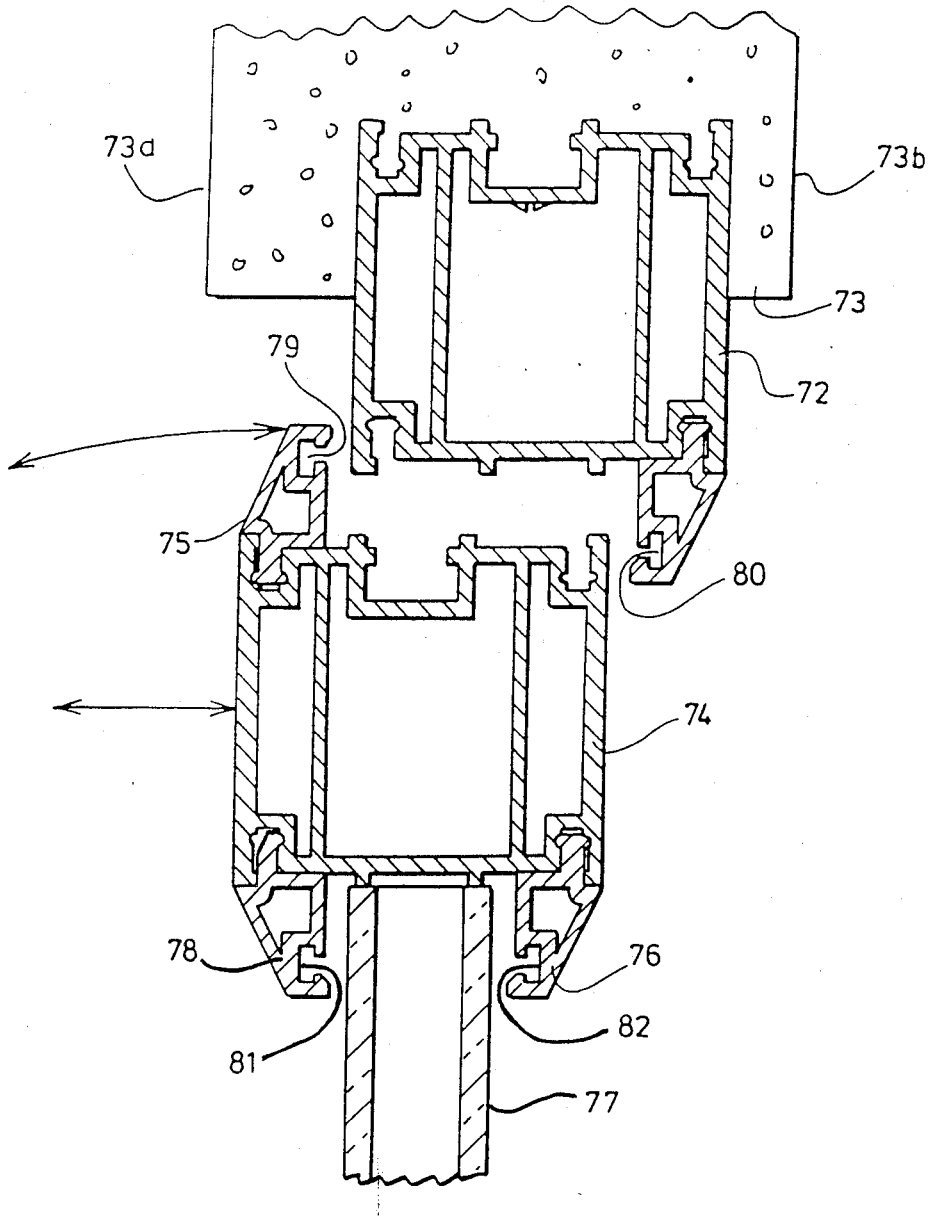

FIGS. 5(*a*), (*b*) and (*c*) are cross-sections on a reduced scale of completed frame moldings in various cross-sectional shapes;

FIG. 6 is a cross-section on the same scale as FIG. 5, showing an arrangement of frame moldings to form a frame for an outward-opening door; and FIG. 7 is a cross-section on the same scale as FIG. 5, showing an arrangement of frame moldings to form a frame for a tilt-and-turn window.

Figure 1:
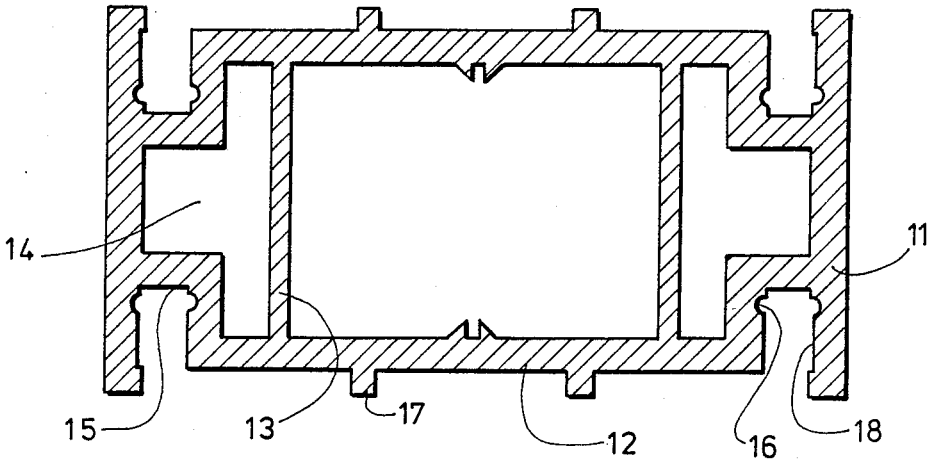
FIG. 1 is a cross-section of a core section.

With reference firstly to FIG. 1, a core section for a door or window frame molding is shown in cross-section having a generally rectangular shape with end walls 11 connected by side walls 12 with internal reinforcements 13. The spaces 14 bounded by the end walls 11 and reinforcements 13 also act as drainage channels. A groove 15 is formed at each corner position of the core section, the grooves having side walls in which opposed channels 16 are formed. Longitudinal reinforcement strips 17 are formed integrally with the side walls 12. The inner-facing surfaces of the grooves are cut away at 18 to reduce sliding surface area, and hence friction, on insertion of the tongue of an adaptor section within the groove.

Figure 2:
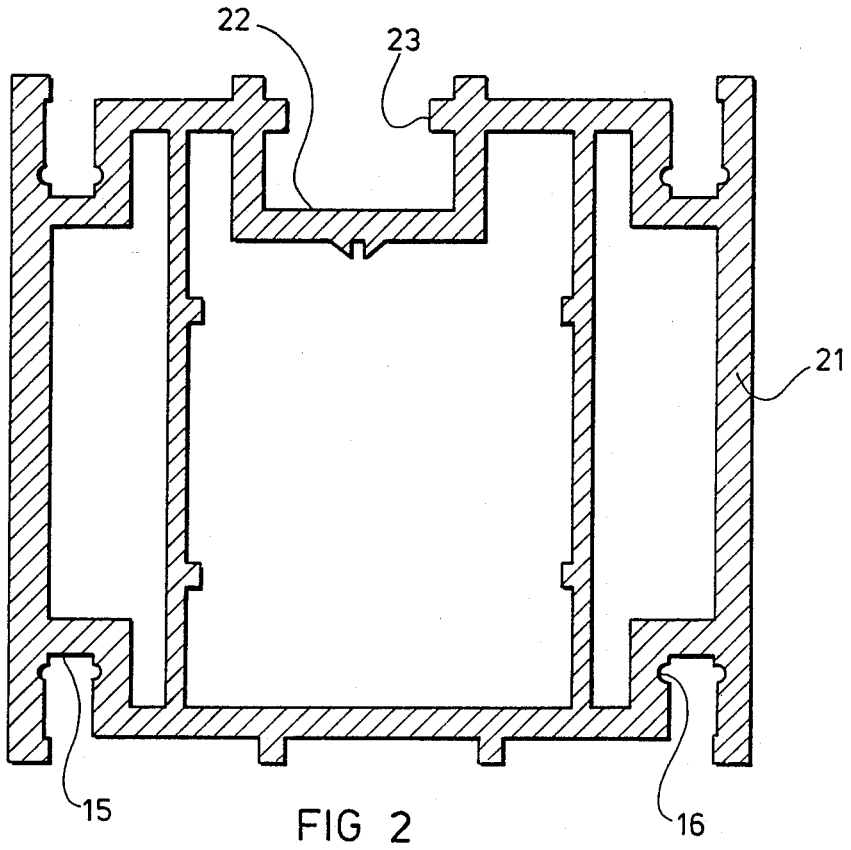
FIG. 2 is a cross-section of a core section including a channel for receipt of operating mechanisms.

As shown in FIG. 2, a similar core section to that depicted in FIG. 1 is shown, except that it has longer end walls 21 and has a longitudinal channel 22 formed in one side wall. The channel 22 has a depth and width to "Eurochannel" specification such that, together with ledges 23, it can accommodate operating mechanisms.

Figure 3:
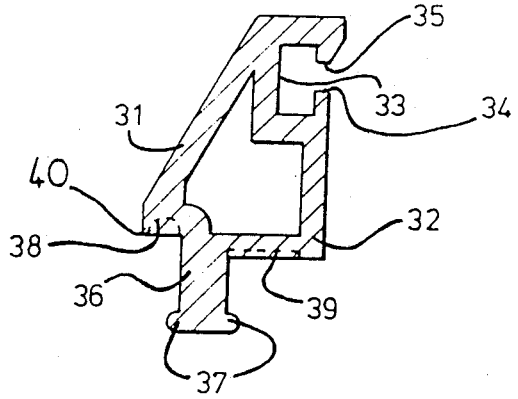
FIG. 3 is a cross-section of an adaptor section.

FIG. 3 illustrates one form of an adaptor section for sliding interlockable engagement with the core section of either FIG. 1 or FIG. 2. The adaptor is of essentially triangular cross-sectional shape and comprises a sloping front face 31, an upright rear face 32, and a groove 33 with restricted access through a slot defined by an upward extension 34 of rear face 32 and an overhanging lip 35. The groove 33 is for receipt of a resilient weatherproofing strip (not shown). A longitudinal tongue 36 is provided at its extremity with laterally extending portions 37; the tongue is slidingly insertable in grooves 15 of the core sections of FIGS. 1 and 2, and the adaptor is laterally held therein by the interaction of the portions 37 in opposed channels 16 (FIGS. 1 and 2). The dotted lines at 38, 39 show one way of profiling mating surfaces of the adaptor section with the core section to reduce the sliding surface area. This avoids substantial jamming on inserting the tongue in the groove and also provides resilience to the corner 40 to facilitate a better seal with the mating corner of the core section.

Figure 4:
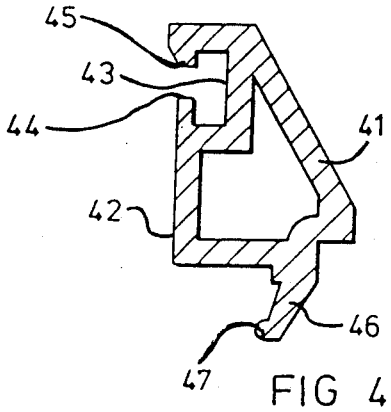
FIG. 4 is a cross-section of a profiled glazing strip.

As shown in FIG. 4, a profiled strip for glazing comprises a sloping front face 41, upright rear face 42, groove 43, upward extension 44 of rear face 42, and overhanging lip 45, corresponding to features 31–35 of the adaptor section of FIG. 3. The profiled strip further includes an inwardly-angled longitudinal tongue 46 provided at its extremity with a laterally extending lug portion 47. The tongue 46 is insertable laterally in grooves 15 (FIGS. 1 and 2) by holding the strip at an angle so that the tongue lies within the groove and then tilting so that the lug portion 47 engages in a channel 16. The presence of glazing prevents the strip tilting back to the angled position, thus ensuring that the strip is laterally held in position.

FIGS. 5 (*a*), (*b*) and (*c*) illustrate how core sections as shown in FIG. 1 and adaptor sections as shown in FIG. 2 can be interlocked to form an L section molding (FIG. 5(*a*)), a T section molding (FIG. 5(*b*)) and a Z section molding (FIG. 5 (*c*)).

FIG. 6 illustrates a cross-section of a side portion of a complete frame assembly for an outward-opening door, in which an L section light-duty molding 61, similar to that illustrated in FIG. 5(*a*), is attached to a masonry wall 62, having an interior face 62*a* and an exterior face 62*b*. The frame of the opening casement is provided by a T shaped molding constituted by a heavy-duty core section 63 including a mechanism channel and adaptor sections 64 and 65. Glazing 66 is held between adaptor section 64 and a profiled glazing strip 67, resilient gaskets being held within grooves 68 and 69 but omitted from the drawing for the sake of clarity. The door is hinged about the frame (not shown) at the other side and therefore opens and closes as shown by the arrow. The adaptor section 65 is of rectangular, rather than triangular, cross-sectional shape and is provided to abut frame molding 61 when the door is closed. Resilient sealing gaskets (not shown) are provided in groove 70 of adaptor section 65 and groove, 71 of the adaptor section forming part of frame molding 61.

Referring to FIG. 7, a cross-section of a side portion of a complete frame for a tilt-and-turn window consists of an L section molding 72 formed from a heavy-duty core section with a mechanism channel (not in use as such) and a triangular adaptor section secured to the masonry 73 at one side of the window aperture, the masonry having an interior face 73*a* and an exterior face 73*b*. The frame of the opening casement is provided by a Z-shaped molding constituted by a heavy-duty core section 74 and triangular adaptor sections 75 and 76. Glazing 77 is held between adaptor section 76 and profiled glazing strip 78, accessible from the interior. Resilient sealing gaskets (not shown) are provided in grooves 79, 80, 81 and 82. In use, the casement can turn inwardly for ventilation or exterior cleaning, about a vertical axis at the other side frame, so that it opens and closes in the direction shown by the curved arrow, or can tilt inwardly about a horizontal axis either at the bottom of the window or at a midway position, so that it opens and closes in the direction shown by the straight arrow.

I claim:

1. A window glazing assembly comprising a window frame having frame members each including a core section, at least one adaptor section and a profiled glazing strip, in which the said core section and adaptor sections form an L, T or Z-shaped cross section, the core section having a generally rectangular cross sectional shape and being provided with longitudinal grooves defined by side walls and formed with one of said grooves in each corner region thereof and the adaptor section being provided with a tongue which is insertable within a selected one or more of said grooves to form said L, T or Z-shaped cross section, said grooves having opposed channels formed in the walls thereof and said tongue having respective lateral beadings which mate with said channels when the core section and adaptor section are assembled to form said frame, and said profiled glazing strip having an inwardly-angled tongue whereby the tongue is inserted within a groove adjacent to the or one of said adaptor sections, whereby the said adaptor section and profiled glazing strip define between them a glazing-retaining channel.

2. An assembly according to claim 1, in which the core section is provided with a longitudinal channel in at least one face thereof to accommodate a window or door operating mechanism.

3. An assembly according to claim 2, in which the core section includes webs which define internal longitudinal cavities which act as water collection and drainage channels.

4. An assembly according to claim 1, in which the inwardly-angled tongue of the glazing strip is provided at its extremity with a laterally extending portion which cooperates with one of said channels formed in the walls of the groove.

5. An assembly according to claim 4, in which the core section includes webs which define internal longitudinal cavities which act as water collection and drainage channels.

6. An assembly according to claim 1, in which the core section includes webs which define internal longitudinal cavities which act as water collection and drainage channels.

* * * * *